US010443195B2

(12) United States Patent
Contrino et al.

(10) Patent No.: US 10,443,195 B2
(45) Date of Patent: Oct. 15, 2019

(54) CONCRETE EDGING TOOL

(71) Applicants: James Contrino, Oceanside, NY (US); Edgardo Alberto Sierra Deras, Valley Stream, NY (US)

(72) Inventors: James Contrino, Oceanside, NY (US); Edgardo Alberto Sierra Deras, Valley Stream, NY (US)

( * ) Notice: Subject to any disclaimer, the term of this patent is extended or adjusted under 35 U.S.C. 154(b) by 132 days.

(21) Appl. No.: 15/721,929

(22) Filed: Oct. 1, 2017

(65) Prior Publication Data

US 2019/0100887 A1 Apr. 4, 2019

(51) Int. Cl.

| | |
|---|---|
| ***E01C 19/17*** | (2006.01) |
| ***B28B 11/08*** | (2006.01) |
| ***E04F 21/16*** | (2006.01) |
| ***E04F 21/24*** | (2006.01) |
| ***E04G 21/10*** | (2006.01) |

(52) U.S. Cl.

CPC ..... *E01C 19/178* (2013.01); *B28B 11/0809* (2013.01); *E04F 21/161* (2013.01); *E04F 21/242* (2013.01); *E04G 21/10* (2013.01)

(58) Field of Classification Search

CPC .. E01C 19/178; B28B 11/0809; E04F 21/161; E04F 21/163

See application file for complete search history.

(56) References Cited

U.S. PATENT DOCUMENTS

| | | | | |
|---|---|---|---|---|
| 3,045,271 | A | 9/1960 | Cinotti | |
| 3,025,005 | A | 3/1961 | Dafforn et al. | |
| 3,458,265 | A | 7/1969 | Andrini | |
| 4,492,318 | A | 1/1985 | Luk | |
| 4,737,097 | A | 4/1988 | Cotugno | |
| 4,796,814 | A | 1/1989 | Klemm et al. | |
| 5,160,748 | A | 11/1992 | Gauuan | |
| 5,362,165 | A * | 11/1994 | Kluga | E04F 21/241 15/235.4 |
| 5,632,569 | A | 5/1997 | Szmansky | |
| 6,415,472 | B1 | 7/2002 | Williams | |
| 6,780,369 | B1 | 8/2004 | Darrow et al. | |
| 7,104,725 | B1 | 9/2006 | Kipp et al. | |
| 7,453,349 | B2 | 11/2008 | Matsubara et al. | |
| 7,814,607 | B1 | 10/2010 | Wilson, Sr. | |
| 8,528,152 | B1 | 9/2013 | Hogan | |
| 8,528,153 | B1 | 9/2013 | Hogan | |
| 9,321,062 | B1 * | 4/2016 | Hawkins, Jr. | E04F 21/161 |
| 2005/0036837 | A1 * | 2/2005 | Marshall | B25F 5/00 404/114 |

* cited by examiner

*Primary Examiner* — Shay Karls

(74) *Attorney, Agent, or Firm* — John F. Vodopia

(57) ABSTRACT

A hand-held concrete edger is formed with a rectangular blade having a first, substantially planar part with an upper surface and a lower surface, and a second part extending substantially at a right angle from a long side of the first, substantially planar part, away from the lower surface. A handle extends substantially perpendicularly away from the upper surface of the first, substantially planar part and is configured with a spray device including a water supply and a sprayer, for spraying water onto an advance path of the edger. A control and vibration module is arranged on the upper surface of the substantially planar part and configured with a vibration element that vibrates the rectangular blade.

6 Claims, 3 Drawing Sheets

CONCRETE EDGING TOOL

BACKGROUND OF THE INVENTION

The invention relates to a hand-held concrete edging tool or trowel, broadly, and more particularly relates to a hand-held concrete finishing edging tool or trowel, configured with a water application system and a tool vibration system for applying water and vibrations to a portion of setting concrete, for example, an edge portion to optimize smoothing and finishing, e.g., edging.

As is known, when concrete is poured, it is finished by trowelling to give the concrete work a desire finish and in addition, the edges of the concrete work are finished with an edging tool to provide a rounded or arcuate edge to the work. To realize such a rounded or arcuate edge, edge finishing tools are used. Edge finishing tools generally comprise a flat rectangular portion and a downwardly curved portion along one of the longer edges. The blade is attached to a long, u-shaped handle and is used to finish freshly-poured cement. The downwardly curved portion provides the rounded or arcuate edge during use.

U.S. Pat. No. 3,045,271 to Cinotti discloses a universal concrete edger that is adaptable for use with left- and right-handed concrete workers, having a handle that is rotatable relative to the blade of the edger.

In order to finish or provide a smooth surface to a concrete work, it is frequently necessary to rewet the concrete surface, and this is done separately, usually by dipping a brush into a container of water and splashing water onto the surface to be finished. The blade is then moved across the surface to provide a smooth corner with a bevel. A disadvantage with applying water by splashing from a brush is that it typically fails to uniformly wet the edges of the concrete work, and may result in surface voids and irregularities.

U.S. Pat. No. 5,362,165 to Kluga provides a concrete hand edger tool with water spray, in order to overcome the shortcomings of using a brush to spray water onto and wet edges of a concrete work. The concrete hand edger tool of U.S. Pat. No. 5,362,165 comprises a rectangular blade with opposed ends, and a longitudinal handle. A water spray nozzle is provided on the handle and is directed downward and outwardly in a direction beyond one end of the blade. Means are provided to supply water under pressure to the spray nozzle in an intermittent fashion. For example, a water tank is provided between the blade and the handle, and a manually operated pump having a squeeze bulb for operation also is located in the handle for access by a user to spray water in the advance path of the edger. A disadvantage with such a hand edger tool, however, is that the act of pumping the bulb causes an inconsistency in the pressure applied downwardly against a surface of the concrete work, as the tool is passed over the wetted path of the concrete edger.

SUMMARY OF THE INVENTION

The present invention overcomes the shortcomings of known arts, such as those mentioned above.

Broadly, the invention provides a hand-held concrete finishing edging tool or edger, configured with a water application system and a tool vibration system for applying water and vibrations to a portion of setting concrete, to affect a smooth edge, where both systems are electrically or electronically actuated to avoid applying unnecessary, unwanted forces that could affect (blemish) the finished surface of the concrete work.

In an embodiment, the invention provides a hand-held concrete edger is formed with a rectangular blade having a first, substantially planar part with an upper surface and a lower surface, and a second part extending substantially at a right angle from a long side of the first, substantially planar part, away from the lower surface. A handle extends substantially perpendicularly away from the upper surface of the first, substantially planar part and is configured with a spray device including a water supply and a sprayer, for spraying water onto an advance path of the edger. A control and vibration module is arranged on the upper surface of the substantially planar part and configured with a vibration element that vibrates the rectangular blade.

The handle includes a trigger that is actuated by a user's touch to activate the spray device; the spray device comprises a water tank, fillable through a removable water cap, and a pump that operates to draw water from the water tank and expel the water out of the sprayer, onto the advance path of the edger, upon activation via the trigger. In a variation, the water supply comprises a water line that extends from the sprayer, though and out the handle for connection to a water source, external to the edger and when the water line is connected to the water source for intended edger operation, actuation of the trigger causes water from the water source to pass through the water line and be expelled from the sprayer. In this case, the trigger activates a valve that effects a fluid path between the water source and sprayer.

User actuation of the trigger activates the vibration element. In an embodiment, the control and vibration module includes a switch for activation of the vibration element. The control and vibration module includes a battery pack that operates as a source of electrical energy for operating the vibration element and for operating the spray device.

BRIEF DESCRIPTION OF THE DRAWINGS

Further features and advantages of the invention will become apparent from the description of embodiments that follows, with reference to the attached figures, wherein.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1A:
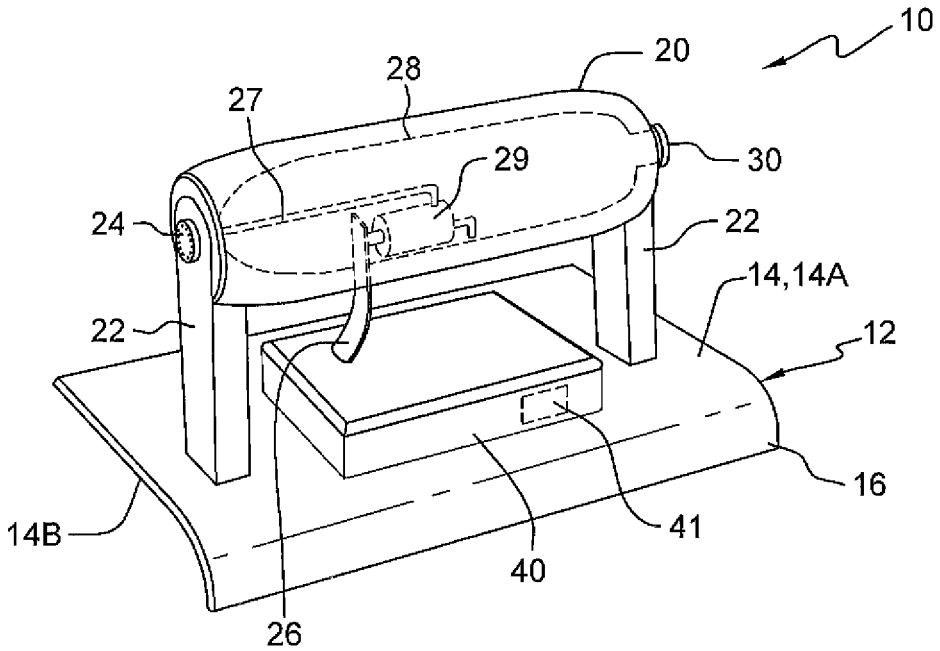
FIG. 1A presents a top perspective view of a hand-held concrete edger constructed according to the invention.
Figure 1B:
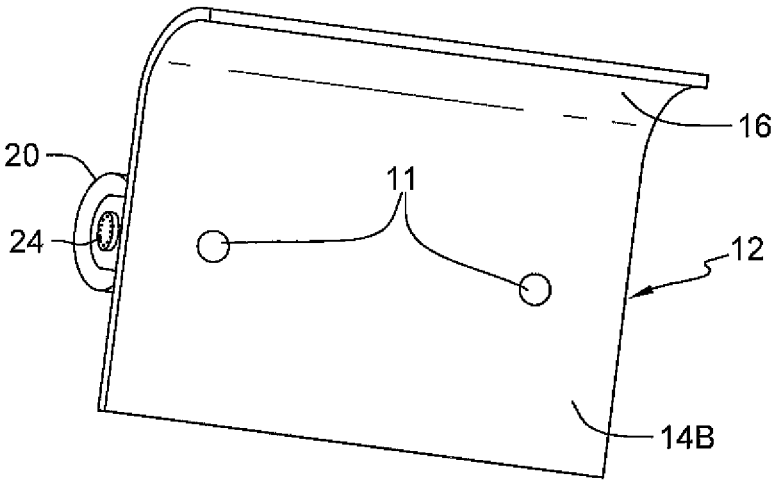
FIG. 1B shows a bottom perspective view of a hand-held concrete edger constructed according to the invention.
Figure 2:
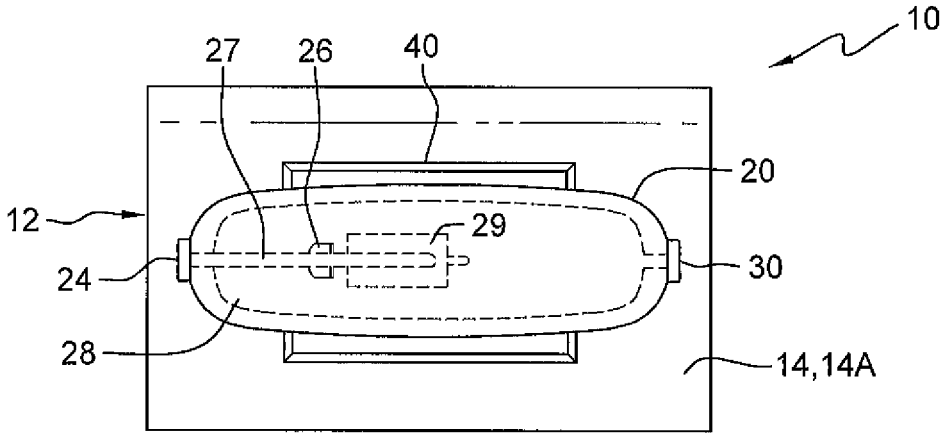
FIG. 2 presents a top plan view of the FIG. 1A embodiment.
Figure 3:
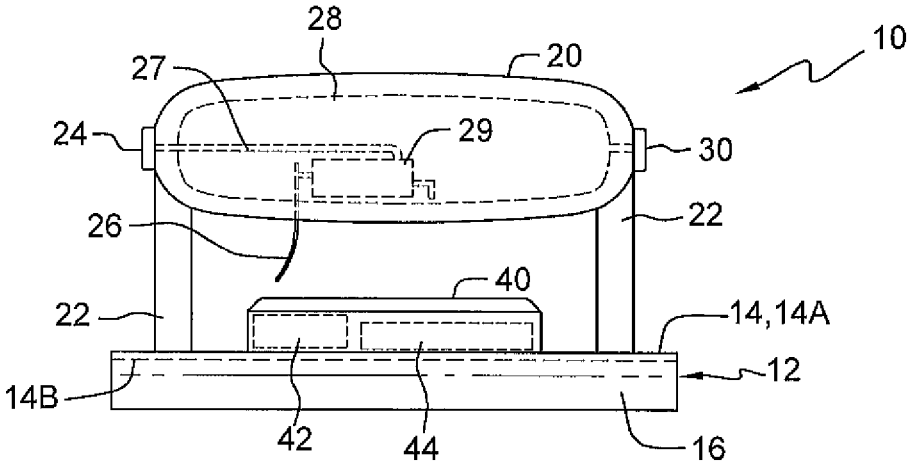
FIG. 3 shows a side view of the FIG. 1A embodiment.

FIG. 1A presents a top perspective view of a hand-held concrete edger 10 constructed according to the invention; FIG. 1B shows a bottom perspective view of the hand-held concrete edger 10 shown in FIG. 1A; FIG. 2 presents a top plan view of the FIG. 1A hand-held concrete edger 10, where FIG. 3 presents a side view of the FIG. 1A hand-held concrete edger 10.

As shown, the hand-held concrete edger 10 comprises a rectangular blade 12 having a first, substantially planar part 14, with an upper surface 14A, a lower surface 14B, and a second part 16 extending substantially at a right angle from a long side of the first, substantially planar part 14, away from the lower surface 14B. The second part 16 preferably extends away from the long side of the substantially planar part in a smooth curve, to realize the 90° extension. The second part 16 provides a clean edge of the concrete work after operation thereon by the edger.

Figure 4:
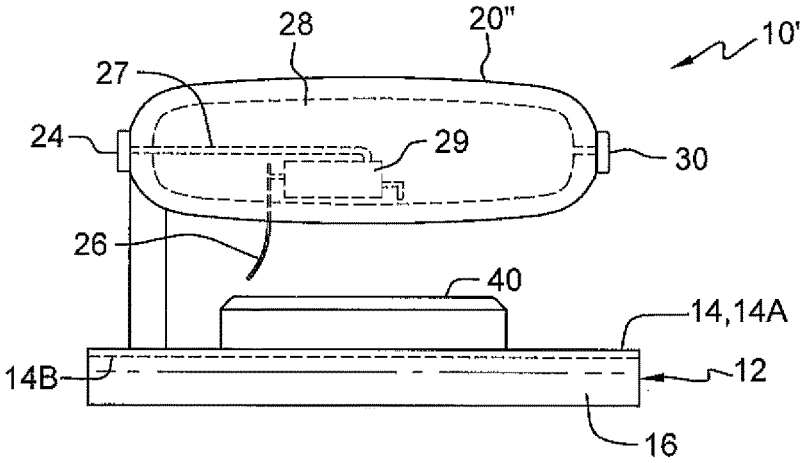
FIG. 4 presents a side view of another embodiment of the hand-held concrete edger constructed according to the invention.

A handle 20 extends substantially perpendicularly away from the upper surface 14A of the first, substantially planar part 14, supported on a pair of handle support members 22. As can be seen in FIG. 1B, the handle is fixed by means for fastening 11, for example, rivets that pass through the substantially planar part 14 to connect the handle support members thereto. The means for fastening do not extend out past the bottom surface 14B. In a variation, however, a concrete-contacting surface of the means for fastening 11 may be set back from the plane of surface 14B a very small amount. Please note that FIG. 4 presents a side view of a concrete edger 10' wherein there is only one handle support member 22. For that matter please note that while the embodiments depicted herein show the second part 16 on one side of the rectangular blade 12, the second part may be provided on an opposite side, so that the edger may be used comfortably by respective left- or right-handed users.

As also shown, the inventive concrete edger is configured with a spray device including a water supply 28 and a sprayer 24, for spraying water onto an advance path of the edger. A control and vibration module 40 is arranged on the upper surface 14A of the substantially planar part 14 and configured with a vibration element 42 that vibrates the rectangular blade 12. The handle 20 includes a trigger 26 that is actuated by a user's touch to activate the spray device. While shown to appear like a "gun trigger" in the figures, the trigger is not limited thereto.

In an embodiment, the spray device comprises a water tank 28, fillable through a removable water cap 30, and a pump (or bulb) 29. The pump 29 operates to draw water from the water tank 28 and pass it pressurized through line 27 to the sprayer 24, to spray the water onto the advance path of the edger, upon activation via the trigger 26. In the embodiment shown, user actuation of the trigger 26 activates the vibration element 42. Alternatively, however, the control and vibration module 40 may include an on/off button or switch 41 that activates the vibration element in one switch state and deactivates in another switch state.

The control and vibration module 40 includes a battery pack 44 that operates as a source of electrical energy for operating the vibration element and for operating the spray device. Preferably, the batteries maintained in the battery pack are rechargeable, and the battery pack includes a connector port for receiving a connector to effect recharging the batteries.

Figure 5:
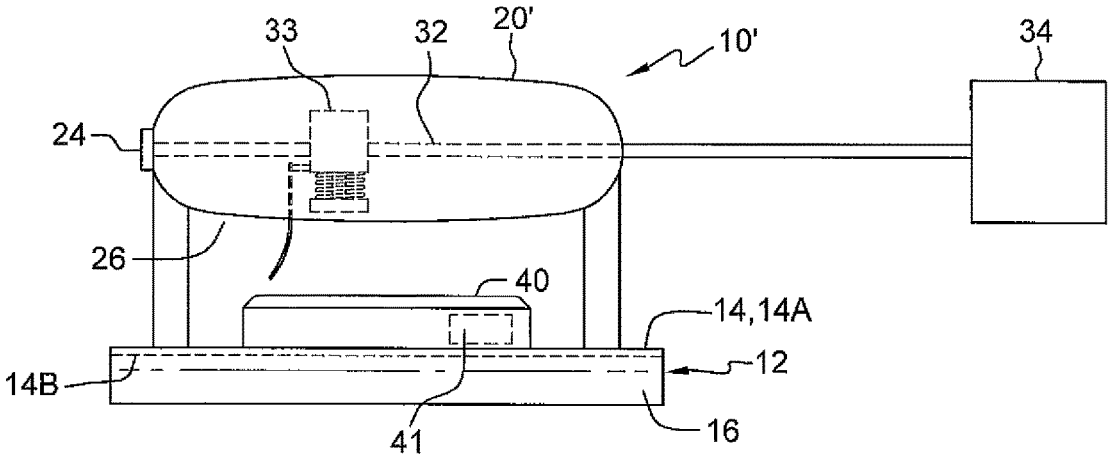
FIG. 5 presents a side view of another embodiment of the hand-held concrete edger constructed according to the invention.

As provided in the edger 10" depicted in FIG. 5, the water supply comprises a water line 32 that extends from the sprayer 24, though a simple valve 33 and out the handle 20 for connection to a water source 34. When the water line 32 is connected to the water source 34 for intended edger operation, actuation of the trigger 26 causes the valve 33 to open a communication path for water from the water source 34 to pass through the valve (via) the water line 32, and be expelled from the sprayer 24 under pressure from the water source 34.

As mentioned above, the vibration mechanism operates with an alternative actuation mechanism, such as a side switch 41, positioned on the battery pack or on the control and vibration module 40. The use of both vibration and sprayed water in the advance path of the edger assures that there will be no bubbles or soft spots in and around the edged portion of the concrete work, and the finished edge will be smooth, even if the edge is worked as the concrete is drying (setting).

In the FIG. 5 embodiment, the trigger 26 is connected to a relay in valve 33 (the relay itself connected to the through a handle support member 22 to the battery), where upon trigger activation, a solenoid of the relay is energized to open the valve water pathway, allowing water to be expelled out of the sprayer 24. While the embodiment may activate the vibration via switch 41, it may alternatively activate the vibration using the same trigger that activates the valve. That is, the trigger 26 may have a first position that electrically activates the vibration element 42, where a second trigger position is what is relied upon to electrically activate the pump 29 and, therefore, the sprayer 24. The user would merely move the trigger past the first position and operate the trigger between the on and off the second "trigger" positions, to intermittently effect spraying.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A hand-held concrete edger, comprising:

a rectangular blade having a first, substantially planar part, with an upper surface, a lower surface and a second part extending substantially at a right angle from a long side of the first, substantially planar part, away from the lower surface;

a handle extending substantially perpendicularly away from the upper surface of the first, substantially planar part and configured with a spray device and a trigger; and a control and vibration module arranged centrally on the upper surface of the substantially planar part, substantially under the handle and configured with a vibration element that vibrates the rectangular blade;

wherein the spray device includes a water supply and a sprayer, for spraying water onto an advance path of the edger; and wherein the trigger is actuated by a user's touch to activate the spray device and the vibration element of the control and vibration module.

2. The hand-held concrete edger, as set forth in claim 1, wherein the spray device comprises a water tank, fillable through a removable water cap, and a pump that operates to draw water from the water tank and expel the water out of the sprayer, onto the advance path of the edger, upon activation via the trigger.

3. The hand-held concrete edger, as set forth in claim 1, wherein the water supply comprises a water line that extends from the sprayer, though and out the handle for connection to a water source, external to the edger and when the water line is connected to the water source for intended edger operation, actuation of the trigger causes water from the water source to pass through the water line and be expelled from the sprayer.

4. The hand-held concrete edger, as set forth in claim 3, wherein the trigger activates a valve that effects a fluid path between the water source and sprayer.

5. The hand-held concrete edger, as set forth in claim 1, wherein the control and vibration module includes a switch for activation of the vibration element.

6. The hand-held concrete edger, as set forth in claim 1, wherein the control and vibration module includes a battery pack that operates as a source of electrical energy for operating the vibration element and for operating the spray device.

* * * * *